US010660423B2

(12) United States Patent
Crane et al.

(10) Patent No.: US 10,660,423 B2
(45) Date of Patent: May 26, 2020

(54) SYSTEMS FOR APPLYING COSMETIC COMPOSITIONS

(71) Applicant: L'ORÉAL, Paris (FR)

(72) Inventors: Christine Marie Crane, Watchung, NJ (US); Anke Hadasch, Jersey City, NJ (US); Zachary John Mahoney, Freehold, NJ (US); William Blake Soeters, Middletown, NJ (US); Rolando Gorostiza, Delran, NJ (US)

(73) Assignee: L'ORÉAL, Paris (FR)

( * ) Notice: Subject to any disclaimer, the term of this patent is extended or adjusted under 35 U.S.C. 154(b) by 508 days.

(21) Appl. No.: 15/395,540

(22) Filed: Dec. 30, 2016

(65) Prior Publication Data

US 2017/0258202 A1 Sep. 14, 2017

Related U.S. Application Data

(60) Provisional application No. 62/305,856, filed on Mar. 9, 2016.

(51) Int. Cl.
*A45D 40/26* (2006.01)
*A46B 11/00* (2006.01)

(52) U.S. Cl.
CPC ..... *A45D 40/262* (2013.01); *A46B 11/002* (2013.01); *A45D 2200/1018* (2013.01); *A46B 2200/1053* (2013.01)

(58) Field of Classification Search
CPC ..... A45D 40/262; A45D 2200/1018; A46B 2200/1053; A46B 11/002
See application file for complete search history.

(56) References Cited

U.S. PATENT DOCUMENTS

| | | | | |
|---|---|---|---|---|
| 5,137,038 | A * | 8/1992 | Kingsford | A45D 40/265 132/218 |
| D394,128 | S | 5/1998 | Atkinson | |
| D416,688 | S | 11/1999 | Baltierra | |
| 6,302,607 | B1 | 10/2001 | Burrowes et al. | |
| 7,261,483 | B2 * | 8/2007 | Gueret | A46B 9/021 401/119 |
| D560,035 | S | 1/2008 | Ross | |
| D561,046 | S | 2/2008 | Kerman | |

(Continued)

FOREIGN PATENT DOCUMENTS

| | | |
|---|---|---|
| CN | 101589883 | 12/2009 |
| EP | 1369055 | 12/2003 |

(Continued)

OTHER PUBLICATIONS

International Search Report and Written Opinion dated Jun. 7, 2017, in PCT/US2017/021598.

(Continued)

*Primary Examiner* — Nicholas D Lucchesi
(74) *Attorney, Agent, or Firm* — Oblon, McClelland, Maier & Neustadt, L.L.P.

(57) ABSTRACT

Described herein is a cosmetic system for applying a cosmetic composition including a cosmetic applicator and a cosmetic composition, where the cosmetic applicator includes a container configured to store the cosmetic composition, an applicator head having a non-linear shape with a proximal end and a distal end, and a slit along an axis of the applicator head, the distal end connected to the container.

17 Claims, 13 Drawing Sheets

(56) References Cited

U.S. PATENT DOCUMENTS

| | | | | |
|---|---|---|---|---|
| D570,708 | S | 6/2008 | Kerman | |
| D588,749 | S | 3/2009 | Wittke-Kothe | |
| 7,682,605 | B2 * | 3/2010 | Mateu | A61K 8/19 424/70.12 |
| 7,918,619 | B2 * | 4/2011 | Gueret | A45D 40/262 401/122 |
| D658,504 | S | 5/2012 | McCoy et al. | |
| 8,215,858 | B2 | 7/2012 | Carroll et al. | |
| 8,353,637 | B2 | 1/2013 | Carroll et al. | |
| 9,125,470 | B2 * | 9/2015 | Thiebaut | A45D 34/04 |
| 9,247,805 | B1 * | 2/2016 | Malm | A46B 11/0079 |
| D776,342 | S | 1/2017 | Otani | |
| 2004/0228670 | A1 * | 11/2004 | Colburn | A46B 11/06 401/11 |
| 2005/0217685 | A1 | 10/2005 | Burkholz et al. | |
| 2006/0137999 | A1 | 6/2006 | Williams | |
| 2006/0216104 | A1 | 9/2006 | Bouix et al. | |
| 2008/0060669 | A1 | 3/2008 | Malvar et al. | |
| 2008/0286034 | A1 | 11/2008 | Chu et al. | |
| 2008/0298876 | A1 | 12/2008 | Porter et al. | |
| 2008/0314405 | A1 | 12/2008 | Chu et al. | |
| 2009/0119859 | A1 * | 5/2009 | Podolsky | A46B 11/002 15/167.1 |
| 2010/0166488 | A1 | 7/2010 | Bouix et al. | |
| 2011/0082432 | A1 | 4/2011 | Fontana | |
| 2013/0205524 | A1 * | 8/2013 | Dhami | A46B 5/0095 15/104.94 |
| 2014/0052111 | A1 | 2/2014 | Odermatt et al. | |
| 2015/0374099 | A1 * | 12/2015 | Pires | A45D 40/265 401/130 |
| 2016/0135569 | A1 * | 5/2016 | Caulier | A46B 3/005 401/129 |

FOREIGN PATENT DOCUMENTS

| | | |
|---|---|---|
| KR | 20070106025 | 10/2007 |
| KR | 20090005669 | 6/2009 |
| KR | 20150133841 | 11/2015 |
| WO | WO2008038870 | 4/2008 |

OTHER PUBLICATIONS

International Search Report and Written Opinion dated Jun. 19, 2017, in PCT/US2017/021554.

International Search Report and Written Opinion dated Jun. 19, 2017, in PCT/US2017/021537.

* cited by examiner

| Ex. 1B1 (15 grams bulk in tube) η= 41200 cP (RV-6, 10 rpm) | | | | | |
|---|---|---|---|---|---|
| ID | Slit size (mm) | Dispense force (g) | Result | Suck back | Picture |
| 401 | 1.0 | 1200-1300 | uneven product dispensing | yes |  |
| 403 | 1.4 | 1100-1200 | uneven product dispensing | yes |  |
| 404 | 0.7 | 1000-1100 | uneven product dispensing | yes |  |

| Ex.1B 3 (15 grams bulk in tube) η= 3480 cP (RV-5, 50 rpm) | | | | | |
|---|---|---|---|---|---|
| ID | Slit size (mm) | Dispense force (g) | Result | Suck back | Picture |
| 401 | 1 | 1200-1300 | Mountain, good control with hand | no | |
| 403 | 1.4 | 1100-1200 | Mountain, good control with hand | yes | |
| 404 | 0.7 | 1200-1300 | Mountain, too much inner | yes | |

FIG. 9

| Commercial Product A | | | | | |
|---|---|---|---|---|---|
| ID | Slit size (mm) | Dispense force (g) | Result | Suck back | Picture |
| 401 | 1 | 1100-1200 | uneven product dispensing | no |  |

SYSTEMS FOR APPLYING COSMETIC COMPOSITIONS

CROSS REFERENCE TO RELATED APPLICATIONS

The present application claims the benefit of priority under 35 U.S.C. § 119(e) from U.S. Ser. No. 62/305,856, filed Mar. 9, 2016, the entire contents of which is hereby incorporated by reference.

FIELD OF THE INVENTION

The present disclosure relates generally to systems for applying cosmetic compositions to keratinous material, in particular to applicators containing a slit and associated cosmetic compositions for application to hair, eyebrows and/or eyelashes.

BACKGROUND OF THE INVENTION

Cosmetic compositions for making up keratinous materials such as eyebrows and/or eyelashes (mascaras) typically are marketed in a system including a reservoir in which the composition is stored together with a brush for applying the composition to eyebrows and/or eyelashes. Application of such mascaras occurs by placing the brush into the reservoir, coating the brush with mascara, withdrawing the brush from the reservoir, and applying the mascara to eyebrows and/or eyelashes. This can be a problematic process.

More specifically, traditional mascara applicators typically include a slender brush having a cap on one end that provides a handle, which may be threaded upon the neck of a container with the brush located within the mascara. In operation, the cap on the end of the brush is unscrewed from the container neck with one hand, and the brush is removed bearing a supply of mascara on its bristles. The user may then stroke the mascara-laden bristles upon the eyelashes, and upon completion of the application replace the brush back with its bristles housed within the container and its supply of mascara. Such applicators are not as well-suited for a single hand operation and application.

Further, the shape and orientation of brush bristles of the applicator are normally fixed. Therefore, where the design of the brush applicator is well-suited for applying mascara to the lashes of one eye with one hand, they are inherently not as well suited for applying mascara with the same hand to the other eye. For instance, an applicator that has a generally cylindrical, peripheral surface of its brush bristles is better-suited for applying mascara to the central portion of the lashes than to the end portions. In contrast, where the applicator has a conical shape of bristles, with the apex of the conical mass located at the tip of the brush, the brush is well suited for applying with the right hand mascara to right eyelashes, while it is ill-suited for applying mascara to the left eye lashes unless a hand switch is made.

Additionally, for the above described mascara applicators, the user needs to frequently dip the brush in the container supply to secure more mascara on the bristles before further application. Such a frequent dip and apply process may lead to an uneven amount of mascara being transported to the brush bristles, which may result in an uneven application of the mascara.

The result of the above limitations of mascaras is that many consumers forego using mascaras, opting to avoid the often difficult application process.

Thus, there remains a need for improved cosmetic compositions for application to keratinous materials such as mascaras having improved application properties.

Accordingly, one aspect of the present invention is a care and/or makeup and/or treatment system for keratinous material which includes a cosmetic composition having good cosmetic properties such as, for example, long-wearing, easy to remove, possesses good anti-flaking properties and/or possess good anti-smudging properties, where the system allows easy application of the composition to keratinous material.

SUMMARY OF THE INVENTION

The present invention relates to a system for applying a cosmetic composition to a keratinous material comprising a cosmetic applicator and a cosmetic composition. The cosmetic applicator includes a container configured to store the cosmetic composition, an applicator head having a linear or non-linear orientation such as a curved, bent or conical shape with a proximal end and a distal end, and a slit along an axis of the applicator head, the distal end connected to the container. Preferably, the container is deformable and/or the applicator head is flocked with flocking extending on a portion of the applicator head, extending over a circumference of the applicator head or extending completely around the circumference of the applicator head, and covering or exposing the slit. Preferably, the cosmetic composition is a mascara and/or the keratinous material is hair, eyebrows and/or eyelashes.

The present invention relates to a system for applying a cosmetic composition to a keratinous material comprising a cosmetic applicator and a cosmetic composition. The cosmetic applicator includes a deformable container configured to store the cosmetic composition, an applicator head having a linear or non-linear orientation such as a curved, bent or conical shape with a proximal end and a distal end, and a slit along an axis of the applicator head, the distal end connected to the deformable container. Preferably, the applicator head is flocked with flocking extending on a portion of the applicator head, extending over a circumference of the applicator head or extending completely around the circumference of the applicator head, and covering or exposing the slit. In response to a deformation force applied to the deformable container, the deformable container transports the cosmetic composition to the applicator head and further to the flocked brush (if present) via the slit for application to the keratinous material. Preferably, the cosmetic composition is a mascara and/or the keratinous material is hair, eyebrows and/or eyelashes.

The present invention relates to a system for applying a cosmetic composition to a keratinous material comprising a cosmetic applicator and a cosmetic composition. The cosmetic applicator includes a cylindrical container (deformable or non-deformable) configured to store the cosmetic composition, an applicator head having a linear or non-linear orientation such as a curved, bent or conical shape with a proximal end and a distal end, and a slit along an axis of the applicator head, the distal end connected to the cylindrical container. Preferably, the applicator head is flocked with flocking extending on a portion of the applicator head, extending over a circumference of the applicator head or extending completely around the circumference of the applicator head, and covering or exposing the slit. In response to a dispensing force applied to the cylindrical container, the cylindrical container transports the cosmetic composition to the applicator head and further to the flocked brush (if present) via the slit. Preferably, the cosmetic composition is a mascara and/or the keratinous material is hair, eyebrows and/or eyelashes.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings:

FIG. 9 shows the results of evaluating a dispensing force for Composition 1B3 in applicators with varying slit sizes.

DETAILED DESCRIPTION OF THE INVENTION

Figure 1:
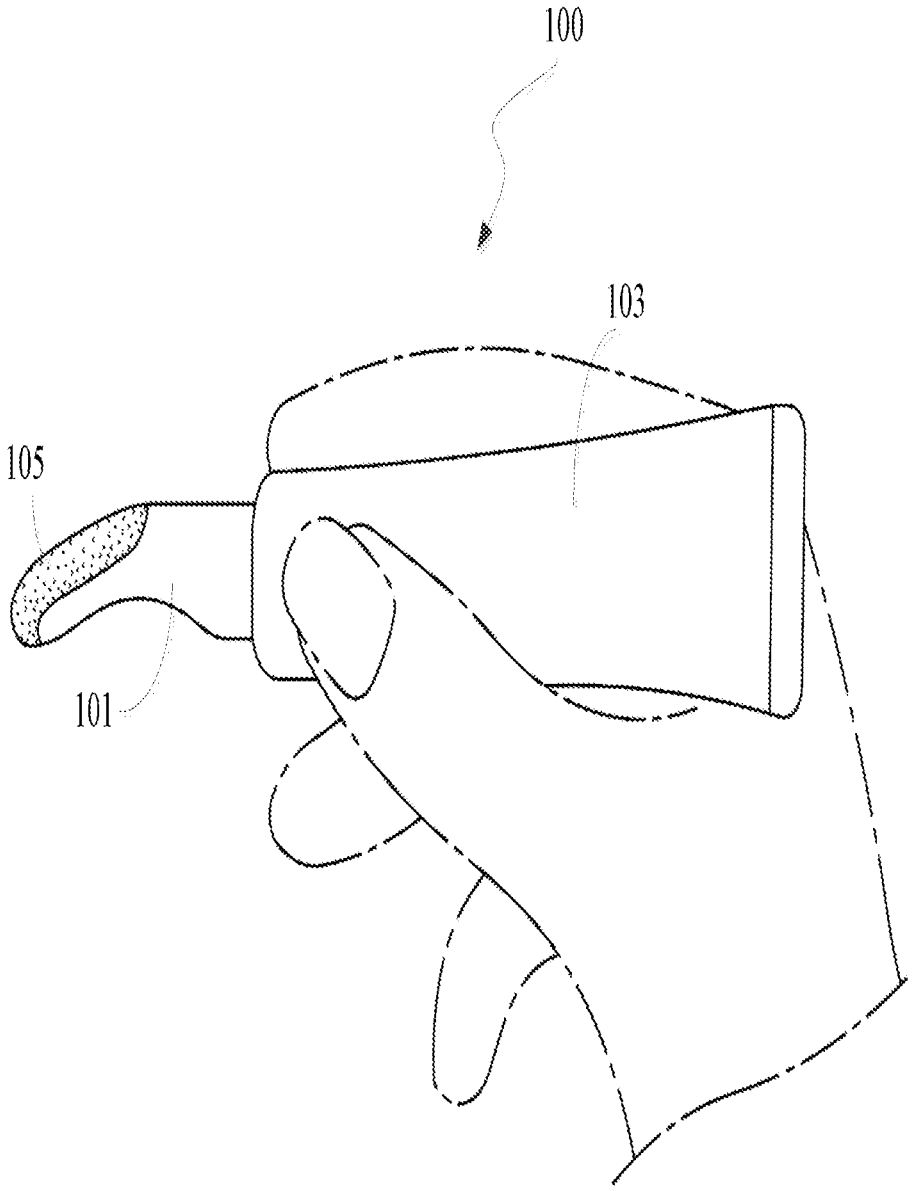
FIG. 1 illustrates according to an embodiment, an exemplary mascara tube including a flocked applicator according to an exemplary embodiment of the present disclosure.

In the following description of the invention and the claims appended hereto, it is to be understood that the terms used have their ordinary and accustomed meanings in the art, unless otherwise specified.

"About" as used herein means within 10% of the indicated number (e.g. "about 10%" means 9%-11% and "about 2%" means 1.8%-2.2%).

"A" or "an" as used herein means "at least one."

As used herein, all ranges provided are meant to include every specific range within, and combination of subranges between, the given ranges. Thus, a range from 1-5, includes specifically 1, 2, 3, 4 and 5, as well as subranges such as and 2-5, 3-5, 2-3, 2-4, 1-4, etc.

"Film former", "film-forming polymer" or "film forming agent" or "co-film former" as used herein means a polymer or resin that leaves a film on the substrate to which it is applied, for example, after a solvent accompanying the film former has evaporated, absorbed into and/ or dissipated on the substrate.

"Wax" as used herein is a lipophilic fatty compound that is solid at ambient temperature (25° C.) and changes from the solid to the liquid state reversibly, having a melting temperature of more than 30° C. and, for example, more than 45° C., which can be as high as 150° C., a hardness of more than 0.5 MPa at ambient temperature, and an anisotropic crystalline organization in the solid state.

"Free" or "devoid" of as it is used herein means that while it is preferred that no amount of the specific component be present in the composition, it is possible to have very small amounts of it in the compositions of the invention provided that these amounts do not materially affect at least one, preferably most, of the advantageous properties of the compositions of the invention. Thus, for example, "free of solvents" means that non-aqueous solvents are preferably omitted (that is 0% by weight), but can be present in the composition at an amount of less than about 0.25% by weight, typically less than about 0.1% by weight, typically less than about 0.05% by weight, based on the total weight of the composition.

"Makeup Result" as used herein, refers to compositions where color remains the same or substantially the same as at the time of application, as viewed by the naked eye, after an extended period of time. "Makeup Result" may be evaluated by evaluating long wear properties by any method known in the art for evaluating such properties. For example, long wear may be evaluated by a test involving the application of a composition to keratin materials such as eyelashes and evaluating the color of the composition after an extended period of time. For example, the color of a composition may be evaluated immediately following application to keratin materials such as eyelashes and these characteristics may then be re-evaluated and compared after a certain amount of time. Further, these characteristics may be evaluated with respect to other compositions, such as commercially available compositions.

"Making up" as used herein means to provide decoration (for example, color) to keratin materials such as the eyelashes.

"Protecting" as used herein means to inhibit damage to keratin materials such as the eyelashes by providing a protective layer on the keratin materials.

"Substituted" as used herein, means comprising at least one substituent. Non-limiting examples of substituents for substitution include atoms, such as oxygen atoms and nitrogen atoms, as well as functional groups, such as hydroxyl groups, ether groups, alkoxy groups, acyloxyalkyl groups, oxyalkylene groups, polyoxyalkylene groups, carboxylic acid groups, amine groups, acylamino groups, amide groups, halogen containing groups, ester groups, thiol groups, sulphonate groups, thiosulphate groups, siloxane groups, and polysiloxane groups. The substituent(s) may be further substituted.

"Water resistance" as used herein, means resistance of a material (substance) to the penetration of water, which may cause degradation of that material. The method implemented if assessment of this invention is further disclosed.

"Transfer resistance" as used herein refers to the quality exhibited by compositions that are not readily removed by contact with another material, such as, for example, a glass, an item of clothing or the skin, for example, when eating or drinking. Transfer resistance may be evaluated by any method known in the art for evaluating such. For example, transfer resistance of a composition may be evaluated by a "kiss" test. The "kiss" test may involve application of the composition to human keratin material such as hair, skin or lips followed by rubbing a material, for example, a sheet of paper, against the hair, skin or lips after expiration of a certain amount of time following application, such as 2 minutes after application. Similarly, transfer resistance of a composition may be evaluated by the amount of product transferred from a wearer to any other substrate, such as transfer from the hair, skin or lips of an individual to a collar when putting on clothing after the expiration of a certain amount of time following application of the composition to the hair, skin or lips. The amount of composition transferred to the substrate (e.g., collar, or paper) may then be evaluated and compared. For example, a composition may be transfer resistant if a majority of the product is left on the wearer's hair, skin or lips. Further, the amount transferred may be compared with that transferred by other compositions, such as commercially available compositions. In a preferred embodiment of the present invention, little or no composition is transferred to the substrate from the hair, skin or lips.

The compositions and methods of the present invention can comprise, consist of, or consist essentially of the essential elements and limitations of the invention described herein, as well as any additional or optional ingredients, components, or limitations described herein or otherwise useful.

Referred to herein are trade names for materials including, but not limited to polymers and optional components. The inventors herein do not intend to be limited by materials described and referenced by a certain trade name. Equivalent materials (e.g., those obtained from a different source under a different name or catalog (reference) number) to those referenced by trade name may be substituted and utilized in the methods described and claimed herein.

All percentages and ratios are calculated by weight unless otherwise indicated. All percentages are calculated based on the total weight of a composition unless otherwise indicated. All component or composition levels are in reference to the active level of that component or composition, and are exclusive of impurities, for example, residual solvents or by-products, which may be present in commercially available sources.

Furthermore, where a range of values is provided, it is to be understood that each intervening value between an upper and lower limit of the range and any other stated or intervening value in that stated range is encompassed within the disclosure. Where the stated range includes upper and lower limits, ranges excluding either of those limits are also included.

The following disclosure is to aid the reader in understanding the present invention, but it is not intended to vary or otherwise limit the meaning of the invention or terms/phrases describing the invention.

System for Applying a Cosmetic Composition to Keratinous Material

According to the present invention, a system for applying a cosmetic composition to a keratinous material comprising a cosmetic applicator and a cosmetic composition is provided. Preferably, the cosmetic composition is a mascara and the keratinous material is hair, eyebrows and/or eyelashes.

Cosmetic Applicator

According to the present invention, a cosmetic applicator comprising a container configured to store the cosmetic composition, an applicator head having a linear or non-linear orientation such as a curved, bent or conical shape with a proximal end and a distal end, and a slit along an axis of the applicator head, the distal end connected to the container is provided. According to preferred embodiments, the slit is along the axis from the proximal end to the distal end of the applicator head, although it should be understood that the slit may also be along an axis which is skew from the proximal end-to-distal end axis. According to preferred embodiments, the cosmetic applicator further comprises a flocked brush with flocking extending on a portion of the applicator head, extending over a circumference of the applicator head or extending completely around the circumference of the applicator head, and covering or exposing the slit.

According to preferred embodiments, the container is a deformable container. In accordance with this embodiment of the present invention, in response to a deformation force applied to the deformable container, the container transports the cosmetic composition to the applicator head for application to keratinous material. According to preferred embodiments, the cosmetic applicator further comprises a flocked brush with flocking extending on a portion of the applicator head, extending over a circumference of the applicator head or extending completely around the circumference of the applicator head, and covering or exposing the slit and the deformation force further transports the cosmetic composition to the flocked brush via the slit for application to the keratinous material.

According to preferred embodiments, the container is a cylindrical container having a depressible element such as, for example, a piston or a plunger. According to this embodiment, the container may be deformable or non-deformable. In accordance with this embodiment of the present invention, in response to a dispensing force applied to the container and/or depressible element, the container transports the cosmetic composition to the applicator head for application to keratinous material. According to preferred embodiments, the cosmetic applicator further comprises a flocked brush with flocking extending on a portion of the applicator head, extending over a circumference of the applicator head or extending completely around the circumference of the applicator head, and covering or exposing the slit and the dispensing force further transports the cosmetic composition to the flocked brush via the slit for application to the keratinous material.

As indicated above, according to preferred embodiments of the present invention, the cosmetic applicator comprises a flocked brush for applying the cosmetic composition (e.g., mascara). A "flocked brush" is constituted of a material which has been made by standard flocking techniques. [A flocked brush is preferred for application of a composition to hair, eyebrows and/or eyelashes. However, if the cosmetic composition is intended for application to skin or lips (for example, a lip gloss), the cosmetic applicator of the invention system need not include a flocked brush.

Exemplary details of the cosmetic applicator of the invention systems will now be described.

Referring now to the drawings, like reference numerals designate identical or corresponding parts throughout the several views. The drawings are not drawn to scale. Accordingly, the following discussion discloses and describes merely exemplary embodiments of the present disclosure. As will be understood by those of ordinary skill in the art, the present disclosure may be embodied in other specific forms without departing from the spirit or essential characteristics thereof. Accordingly, the present disclosure is intended to be illustrative, but not limiting, of the scope of the present invention. The disclosure, including any readily discernible variants of the teachings herein, defines, in part, the scope of the foregoing claim terminology such that no inventive subject matter is dedicated to the public.

FIG. 1 shows an exemplary flocked mascara applicator 100 in which one or more technologies or methodologies can be implemented, such as, for example, having an applicator that provides a mechanism of applying mascara in a seamless manner and/or provides a pleasant sensation when used. In an embodiment, the flocked mascara applicator 100 is a two- to three-piece device including an applicator head 101 having an end portion 101*a* and a deformable container 103 (also referred herein as a tube 103). In an embodiment, the container 103 is provided as a hollow container that carries the cosmetic composition (e.g., mascara or other fluid material) and deforms upon application of force. The tube 103 can be of different shape such as a pipe-shaped, grip shaped, or any other shape that can be held and deformed with fingers or palms.

In one embodiment, the tube 103 is essentially shaped as a cylinder that is pinched (sealed) at one end (distal end) and connected to the applicator head 101 at the other end (proximal end). The tube 103 may be hermetically sealed at the distal end in order to provide a sealed container. Furthermore, the inside walls of the tube 103 may be coated with special coatings in order to inhibit the tube's material from reacting with the contents.

The tube 103 may be attached at its proximal end to the applicator head 101 via any suitable means such as, for example, a locking mechanism such as, for example, a click-lock mechanism during assembly or it may be twisted together with the applicator head 101 via a threading mechanism (not shown). In one embodiment, the tube 103 is a soft-squeezable reservoir that may be made of any suitable deformable material such as, for example, plastic, paperboard, aluminum or the like. The volume of the tube can be of any size, but preferably of a size which contains 1.5 to 20 ml, 1.5 to 17 ml, and preferably 1.5 to 15 ml of cosmetic composition. However, it must be appreciated that smaller-sized tubes can be manufactured, for example, for a travel-size applicator. Furthermore, the applicator 100 can be manufactured as a one-piece unit where the tube and the applicator head forms a unitary construction. Such applicators, upon use, can be discarded, if desired. A refill (with cosmetic composition) provision for the one-piece applicator can also be provided.

The applicator head 101 includes a proximal end that is attached to the tube 101 and a distal end that includes a flocked brush 105. The applicator head 101 may be made of a soft or hard material. In one embodiment, the applicator head is curved in shape, wherein the degree of curvature is such that the mascara tube 100 provisions for easy application of the mascara to curved surfaces such as a user's eyebrows and/or eyelashes. The degree of curvature may be predetermined in a manner that is deemed appropriate to one of ordinary skill in the art to achieve desired application to the desired keratinous material. Additionally, in an embodiment, the flocked brush 105 may be oriented in a manner such that a longitudinal axis or the flocked brush is substantially parallel to the longitudinal axis of the tube 103.

Figures 2A, 2B:
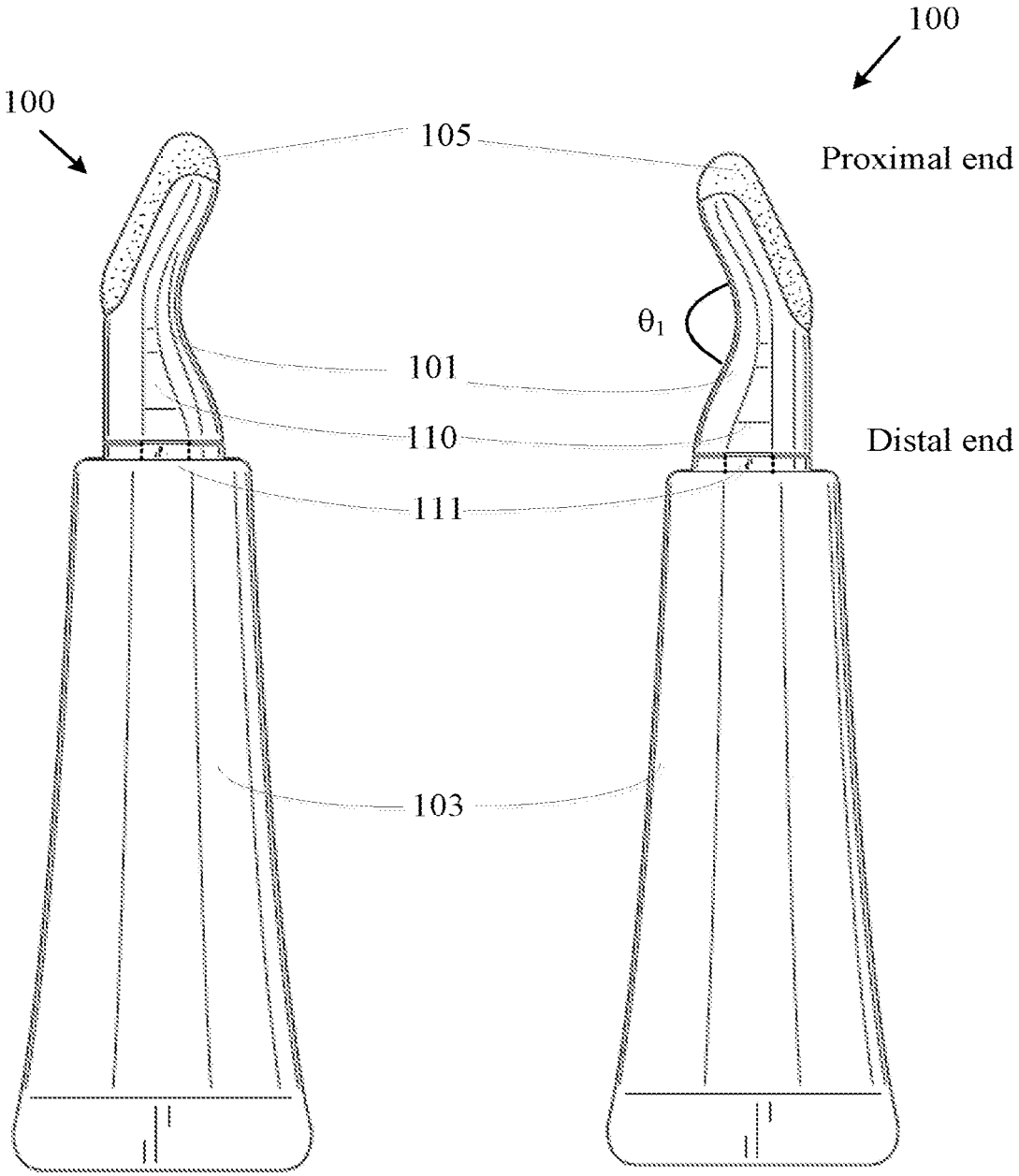
FIGS. 2A and 2B depict exemplary left and right side prospective views of the mascara tube of FIG. 1 according to an exemplary embodiment of the present disclosure.

As shown in FIGS. 2A and 2B that depict left and right side perspective views of the flocked applicator 100, respectively, the flocked material (brush) 105 is extended over an end portion 101*a* of the applicator head 101, and around the circumference. For example, the flocked brush 105 can be spread partially or fully along the circumference of the applicator head 101. In one embodiment, the flocked brush 105 preferably covers one-third to one-half of the circumference of the applicator head 101. In doing so, the mascara applicator provisions for the application of the mascara at the corners and bottom of eyelashes in an easy manner. The extension of the flocked brush 105 over the end portion 101*a* of the applicator head 101 is further shown in FIGS. 2C and 2D which depict the front side and back side prospective views of the mascara tube of FIG. 1. Moreover, FIGS. 2E and 2F depict exemplary top and bottom views of the mascara tube of FIG. 1, respectively.

Referring to FIG. 2A and 2B, the applicator head 101 has a curvature defined by an angle $\theta_1$. Due to the curvature, the flocked brush 105 is inclined with respect to a longitudinal axis of the applicator 100. Increasing or decreasing the angle $\theta_1$ can affect the amount of mascara transported to the flocked brush 105. For example, an acute angle $\theta_1$ (e.g., less than 90°) may need higher force on the tube 103 compared to an obtuse angle $\theta_1$ (e.g., greater than 100°) to transport a particular amount of mascara to the flocked brush 105. Providing an optimum curvature should be maintained to allow easy transportation and application of cosmetic composition such as mascara. Preferably, the angle $\theta_1$ is between about 90 and about 260, preferably between about 110 and about 200, and preferably about 120 and about 180. The angle $\theta_1$ may also interact with properties of the cosmetic composition such as, for example, viscosity, consistency, and critical strain. For example, for a lower viscosity and/or lower consistency mascara, a smaller angle may provide sufficient resistance to transport an optimum amount of mascara to the flocked brush 105 than a higher viscosity and/or consistency.

The flocked mascara applicator 100 provisions for easy transport of the mascara from the tube to the flocked brush 105 and utilizes the curvature of the applicator head 101 for easy application of the mascara. Furthermore, it may be possible to provide for refills of the tube and/or switching the applicator head.

Figure 2C:
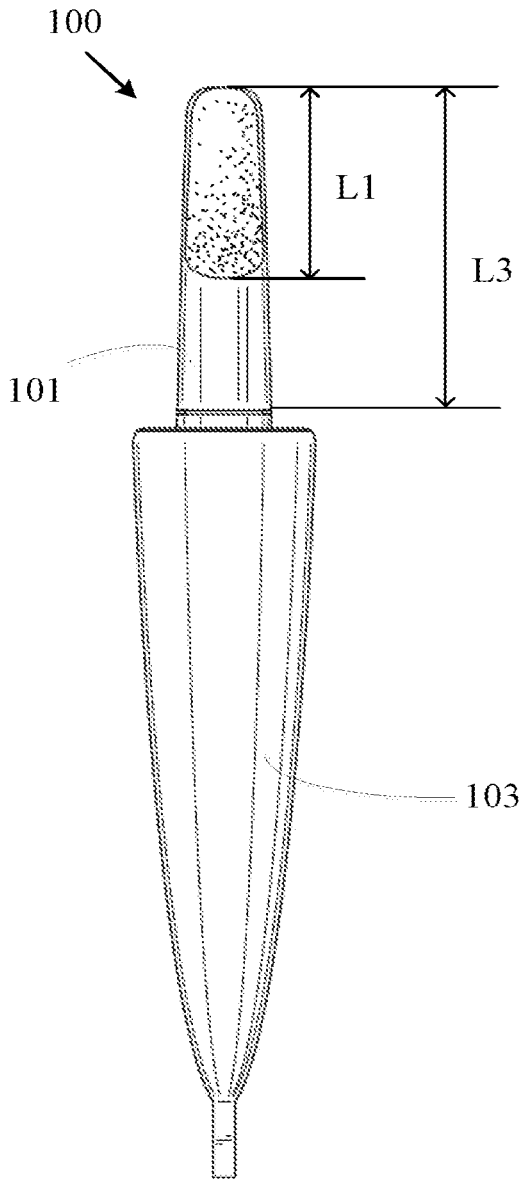
FIGS. 2C and 2D depict exemplary front side and back side prospective views of the mascara tube of FIG. 1 according to an exemplary embodiment of the present disclosure.
Figure 2D:
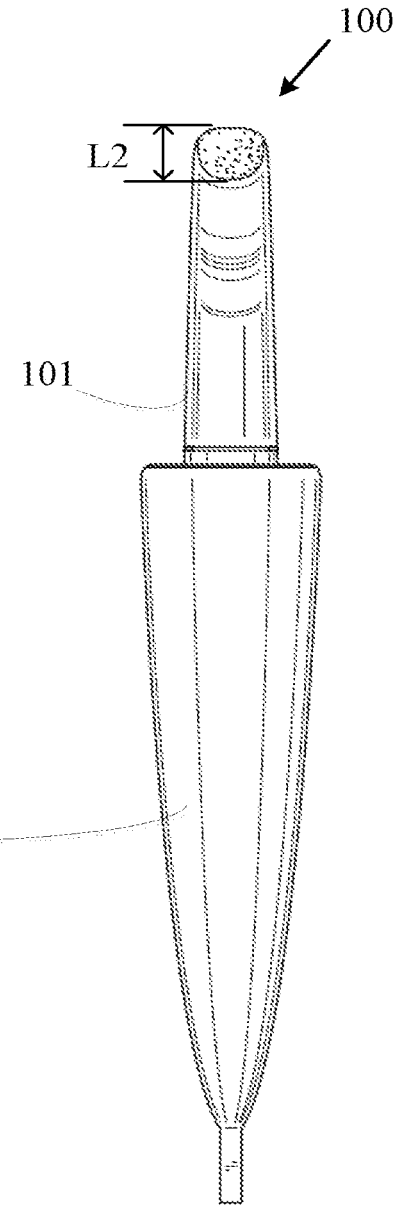
Figure 2E:
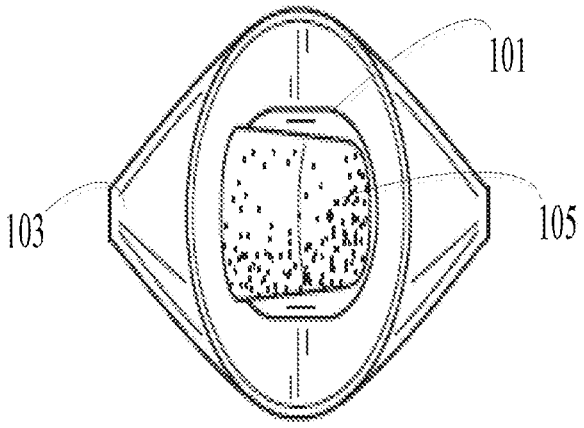
FIGS. 2E and 2F depict exemplary top and bottom views of the mascara tube of FIG. 1 respectively according to an exemplary embodiment of the present disclosure.
Figure 2F:
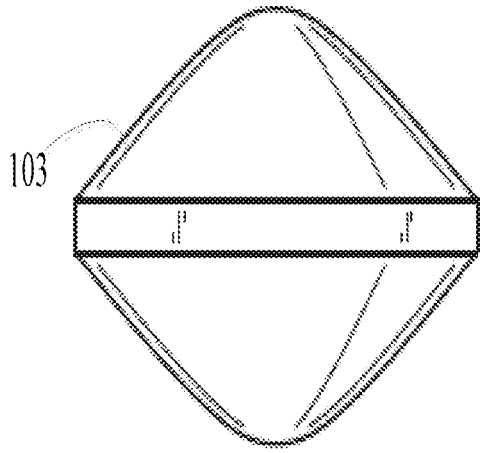

Referring to FIG. 2C and 2D, the applicator head 101 can be of length L3, and the flocked brush 105 can have a length L1 on the front side and a length L2 on the back side of the applicator head 101. The length of the flocked brush 105 can also affect an optimum amount of mascara discharged on the flocked brush 105. For example, if the length L1 of the flocked brush 105 is long, more mascara may be discharged to realize a uniform wetting of the flocked brush 105.

Referring back to FIGS. 2A and 2B, the applicator head 101 has an interior applicator channel 110 conforming to the shape of the applicator head 101. The interior applicator channel 101 can extend from an opening of the tube 103 to the end portion 101*a* of the applicator head 101. The interior applicator channel 110 receives mascara from the tube 103 via hole(s) (refer to FIG. 7) and transports the mascara to the flocked brush 105. The interior applicator channel 101 can have a diameter preferably ranging from 0.5 mm to 5 mm, preferably 0.75 mm to 4.5 mm, and preferably from 1 mm to 3 mm. The channel 101 can have a uniform diameter or can have a varying diameter of any type, for example a diameter decreasing or increasing towards the end portion 101*a* of the applicator head 101 resulting in a tapered shape. Such tapering is particularly preferred in embodiments in which the applicator head has a conical shape. The size of the hole is such that there is little or no leakage of mascara between the tube hole(s) and the interior applicator channel 110.

The flocked brush 105 can be made of any suitable material used for flocking materials such as, for example, polyamides, polyesters, rayons, cottons, celluloses, polyacryles, carbon fibers, aramids, etc. Suitable materials include those made and sold under the Hytrel® name. Preferably, the flocked brush 105 is made of materials having (1) 1.5 to 90 dtex, preferably 10 to 80 dtex, and preferably 15-70 dtex, including all ranges and subranges therebetween, (2) 0.5 to 3 mm in length, preferably 0.6 to 2.9 mm in length, and preferably 0.7 to 2.5 mm in length, including all ranges and subranges therebetween, and/or (3) 0.03 to 0.09 mm in diameter. The flocked brush 105 may optionally include polymeric micro-bristles that may be adhered to the applicator head 101 by injection molding techniques, electrostatic techniques and the like. In use, the flocked applicator 100 can transport the mascara from the tube 103 to the flocked brush 105 upon squeezing of the tube 103 (deformable container) or by employing a depressible elements such as a movable piston mechanism within the tube 103 to push the mascara onto the flocked brush 105. The cosmetic composition deposited on the flocked brush 105 may then be applied to the hair, eyebrows and/or eyelashes of the user.

Figure 3:
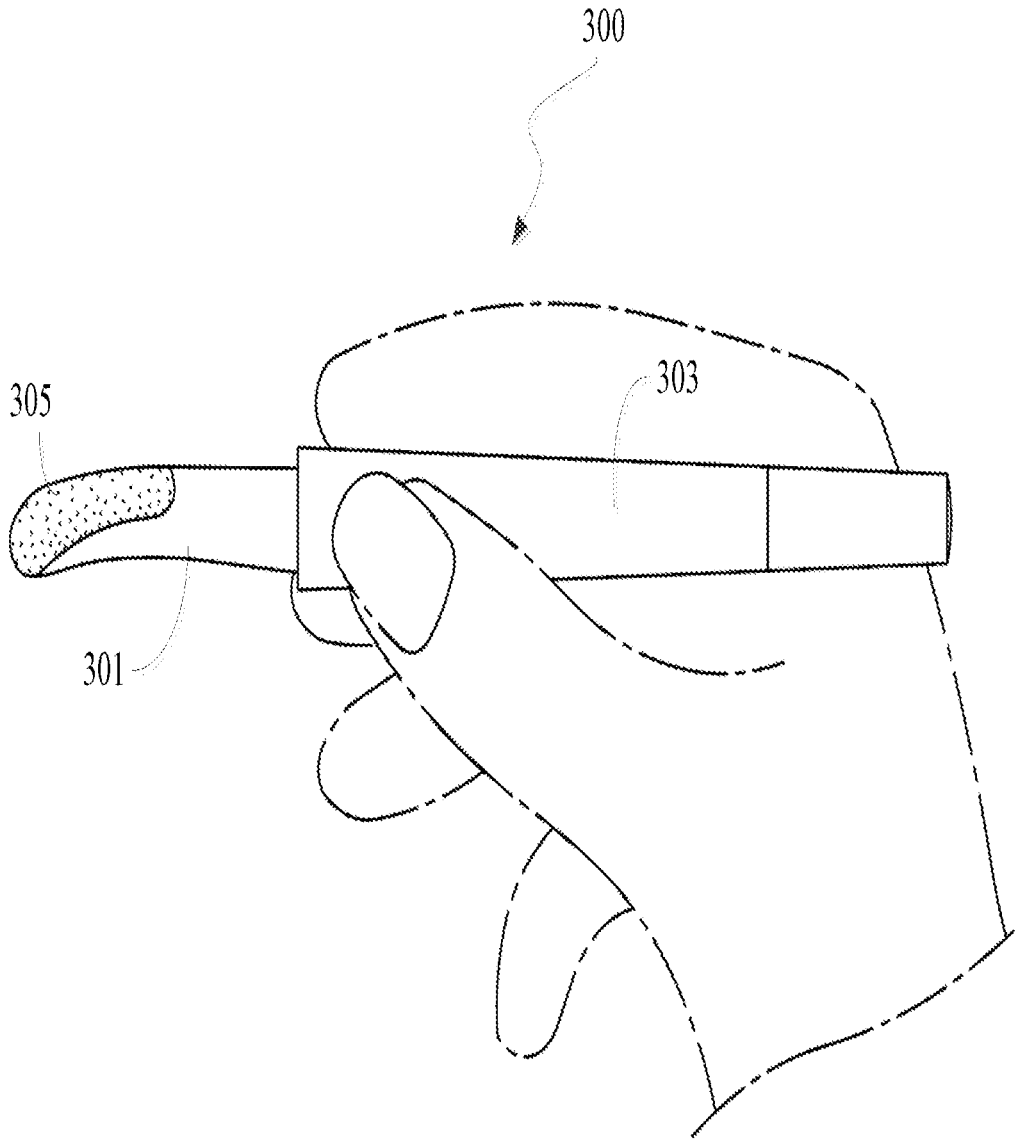
FIG. 3 depicts according to an embodiment, an exemplary mascara pen including a flocked applicator according to an exemplary embodiment of the present disclosure.

Referring to FIG. 3, an example of a flocked mascara applicator 300 which is a three piece device including an applicator head 301 having an end portion 301*a* and a pen 303 that has a pen-shaped structure is depicted. The body of the pen 303 is a hollow cylindrical container (deformable or non-deformable) that carries the cosmetic material (mascara). In one embodiment, the pen is air-sealed at one end (distal end) and connected to the applicator head 301 at the other end (proximal end). Additionally, the inside walls of the pen may be coated with special coatings in order to prevent the tube's material from reacting with the contents.

The pen 303 may be attached at its proximal end to the applicator head 301 via any suitable means such as, for example, a locking mechanism such as, for example, a click-lock mechanism during assembly or it may be twisted together with the applicator head 301 via a threading mechanism. The pen 303 may be made of plastic, aluminum or the like. The volume of the pen can be of any size, but preferably of a size which contains 0.75 to 5 ml, 1 to 4.5 ml and preferably 1.5 to 4 ml of cosmetic composition. However, it must be appreciated that smaller sized pens can be manufactured, for example, a travel-size flocked applicator. Furthermore, the applicator 300 can be manufactured as a one-piece unit where the pen and the applicator head form a unitary construction. Such applicators, upon use, can be discarded, if desired. A refill (with cosmetic composition) provision for such a one-piece applicator may further optionally be provided.

The applicator head 301 includes a proximal end that is attached to the tube 101 and a distal end that includes a flocked brush 305. The applicator head 301 may be made of a soft or hard polymer-like material. In one embodiment, the applicator head is curved in shape, wherein the degree of curvature is such that the mascara applicator 300 provisions for easy application of the mascara to curved surfaces such as a user's eyelashes as discussed above.

Figures 4A, 4B:
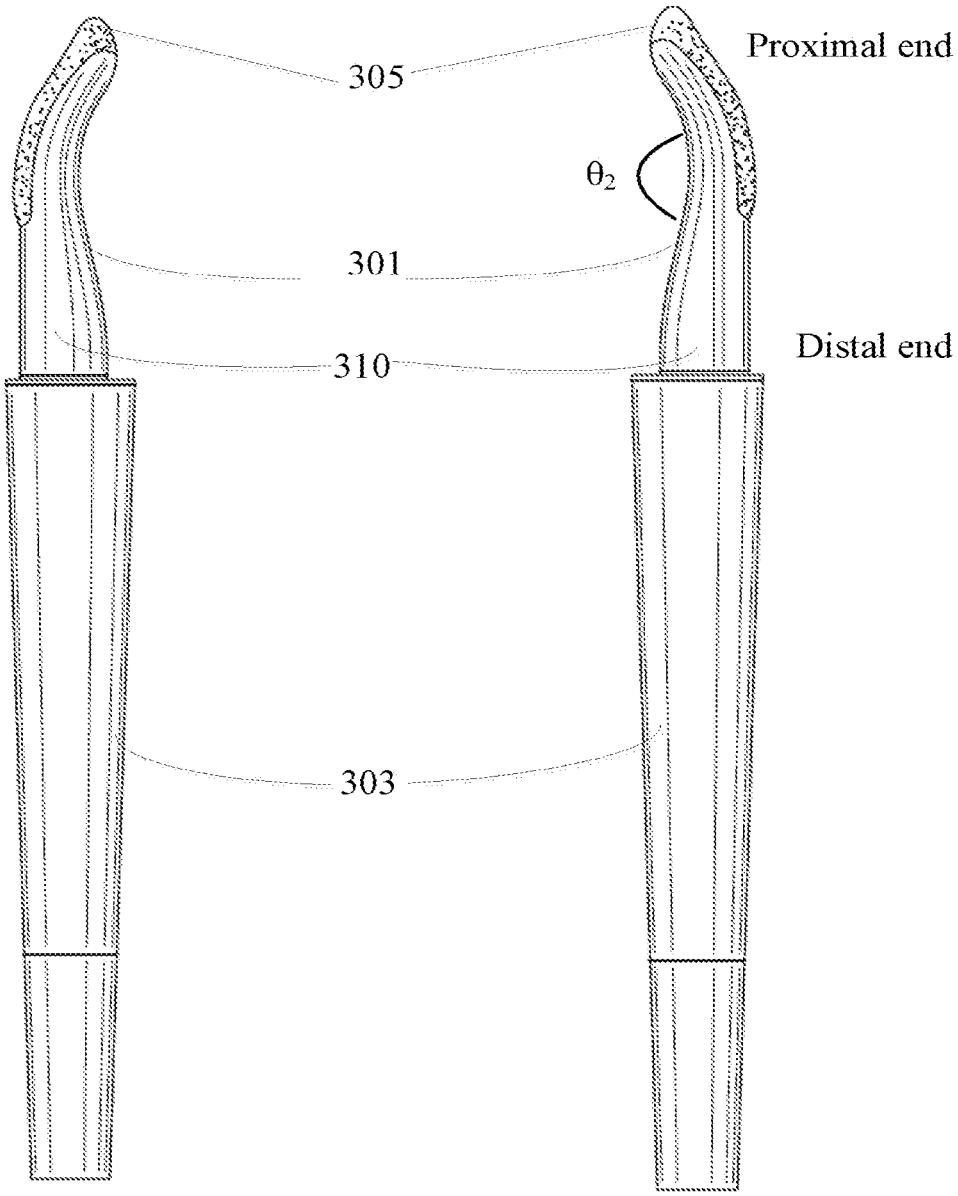
FIGS. 4A and 4B depict exemplary left and right side prospective views of the mascara pen of FIG. 3 according to an exemplary embodiment of the present disclosure.

The flocked brush 305 is preferably made of the materials discussed above. The flocked brush 305 may optionally include polymeric micro-bristles that may be adhered to the applicator head 301 by injection molding techniques, electrostatic techniques and the like. In use, the flocked applicator 300 can transport the mascara from the body of the pen 303 to the flocked brush 305 by using a dispensing mechanism based on clicking or using a push pen with a movable piston-like mechanism. It should be appreciated that any structure that moves the mascara from the pen to applicator 301 can be used. Additionally, the pen 303 may transfer the cosmetic composition to the brush 305 by shaking the pen 303 in a back and forth manner. The cosmetic composition deposited on the flocked brush 105 may then be applied to the hair, eyebrows and/or eyelashes of the user. As shown in FIGS. 4A and 4B that depict left and right side perspective views of the flocked applicator 300, respectively, the flocked material (brush) 305 is extended over the end portion 301*a* of the applicator head 301, around the circumference. For example, the flocked brush 305 can be spread partially or fully along the circumference of the applicator head 301. In one embodiment, the flocked brush 305 can cover one-third to one-half of the circumference of the applicator head 301. Such spread of the flocked brush 305 enables easy application of the mascara at the corners and bottom of eyelashes easier. This is further evident in FIGS. 4C and 4D that depict exemplary front side and back side prospective views of the mascara pen of FIG. 3. Accordingly, the flocked mascara applicator 300 provisions for easy transport of the mascara from the pen 303 to the flocked brush and utilizes the curvature of the applicator head for easy application of the mascara. Moreover, FIGS. 2E and 2F depict exemplary top and bottom views of the mascara pen of FIG. 3 respectively. Furthermore, since the flocked applicator is a two- to three-piece device, a provision of purchasing refills of the tube and/or switching the applicator head can be further provided.

Referring to FIG. 4A and 4B, in one embodiment the applicator head 301 can have a curvature defined by an angle $\theta_2$. The angle $\theta_2$ can be different from the angle $\theta_1$, as the dispensing mechanism for the applicator 300 having the pen 303 can be different, for example, squeezing for tube 103 and shaking or pushing by a movable piston for the pen 303. The curvature of the applicator head 301 (or 101) can be a function of the type of reservoir (e.g., tube 103 or pen 303) and dispensing mechanism. Providing an optimum curvature should be maintained to allow easy transportation and application of mascara. Preferably, the angle $\theta_2$ is between about 90 and about 260, preferably between about 110 and 200, and preferably between about 120 and 180. The angle $\theta_2$ may also interact with properties of the cosmetic composition such as, for example, viscosity, consistency, and critical strain. For example, for a lower viscosity and/or lower consistency mascara, a smaller angle may provide sufficient resistance to transport an optimum amount of mascara to the flocked brush 305 than a higher viscosity and/or consistency.

Figures 4C, 4D:
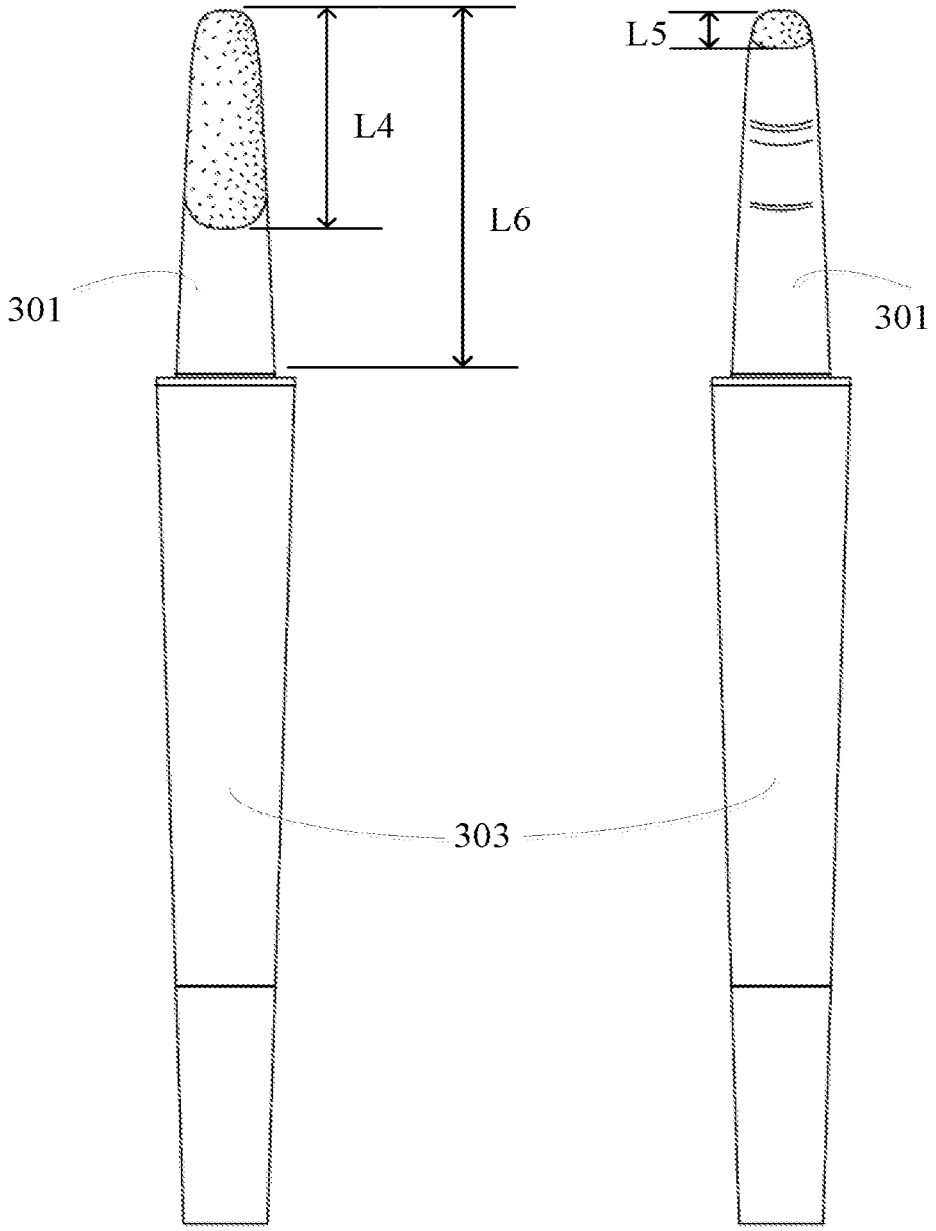
FIGS. 4C and 4D depict exemplary front side and back side prospective views of the mascara pen of FIG. 3 according to an exemplary embodiment of the present disclosure.

Referring to FIG. 4C and 4D, the applicator head 301 can be of length L6, and the flocked brush 305 can have a length L4 on the front side and a length L5 on the back side of the applicator head 301. The length of the flocked brush 305 can affect an optimum amount of mascara discharged on the flocked brush 305. For example, if the length L4 of the flocked brush 305 is long, more mascara should be discharged to wet the flocked brush 305.

It must be appreciated that the shape of the cosmetic applicators 100 and 300 as shown in FIG. 1 and FIG. 3, respectively, can provide for ease of application and positioning of the flocked brush directly in contact with hair, eyelashes and/or eyebrows. For instance, referring to FIG. 1, crimping along the axis of the tube 103, provisions for easier grip of the tube. Such an orientation of the cosmetic applicator positions the flocked brush directly towards the eyelashes, thereby enhancing the ease of cosmetic application, without the need to twist and/or roll the applicator for applying the mascara.

Figure 5A:
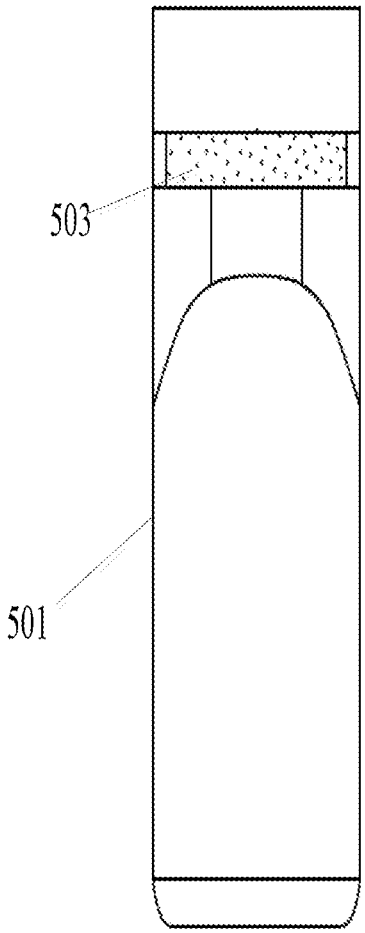
FIGS. 5A and 5B illustrate an exemplary dual function cap according to an exemplary embodiment of the present disclosure.
Figure 5B:
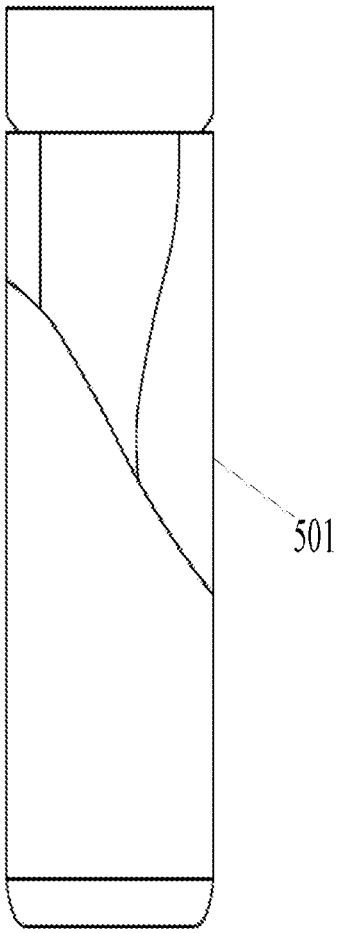

Referring to FIGS. 5A and 5B, exemplary dual function caps are illustrated. As shown in FIG. 5A, the dual function cap includes a cap 501 and a seal 503 that are enclosed in a casing (container) 502. The cap 501 along with the seal 503 prevents the mascara from drying on the applicator head. In one embodiment, the cap 501 may be a mold that has the shape of the applicator head, and can be fitted snugly to cover the applicator head. For instance, the applicator head may be snapped onto the cap or attached via threading and a twist mechanism. The cap 501 can also hold excess bulk composition preventing the applicator from drying out. The cap 501 can also serve the role of holding product vertically in place and can have any shape which allows it to do so. The seal 503 can be made of a hard or soft pliable material and is used to further prevent drying of the mascara. The cap and seal combination may be included in the casing to provide an air tight mechanism in which the applicator head can be maintained. Additionally, the cap can include a holding mechanism such as a snap-on clip, carabiner clip, or the like, which enables a user of the cosmetic applicator to affix the applicator to a bag, pockets of a trouser, and the like, thereby making the cosmetic applicator portable.

The applicator head 101 (or 301) discharges the cosmetic composition such as mascara on to the flocked brush 105 (or 305) via a slit. According to preferred embodiments of the present invention, slit can be of any geometry such as, for example, amorphous, rectangular, oval, triangular, etc. The slit can be positioned anywhere along the length of the applicator head 101 (or 301) covered with the flocked brush 105 (or 305), and can be parallel, perpendicular or skew to any axis of the applicator head. Preferably, the slit has a length which is at least about 40% of the length of the applicator head, preferably at least about 50% of the length of the applicator head, and preferably at least about 60% of the length of the applicator head.

Figure 6A:
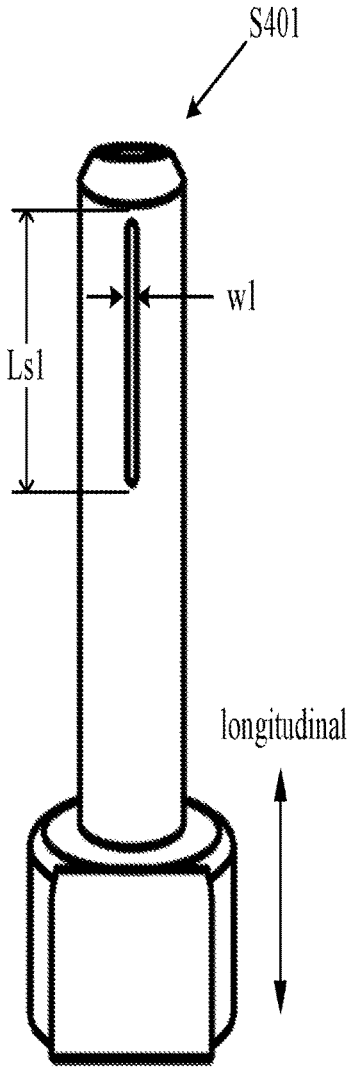
FIGS. 6A, 6B, and 6C illustrate exemplary applicator with slit according to an exemplary embodiment of the present disclosure.
Figure 6B:
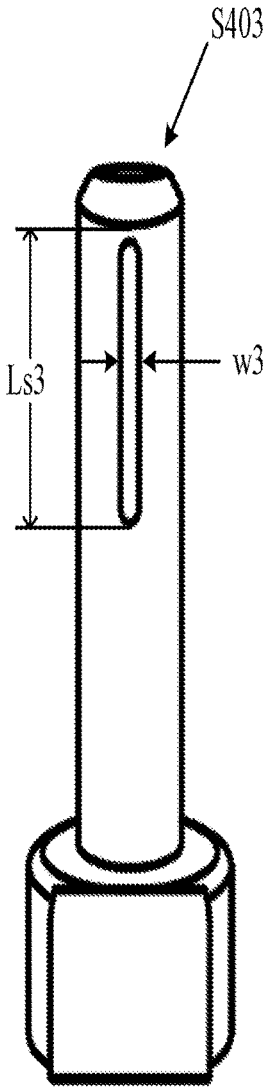
Figure 6C:
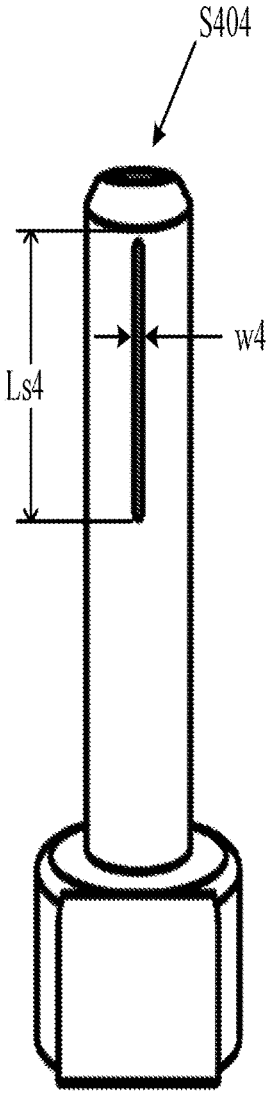

FIGS. 6A, 6B, and 6C illustrate exemplary applicators with slits according to an exemplary embodiment of the present disclosure. According to the present invention, the slit of the applicator head has a length and a width. The cosmetic composition (mascara) flows out of the slits S1A, S1B, and S1C to wet the flocked brush (not illustrated).

Preferably, the slit has a width smaller than 2 mm, preferably smaller than 1.7 mm, preferably smaller than 1.5 mm while preferably being larger than 0.3 mm, preferably larger than 0.5 mm, and preferably larger than 0.7 mm, including all ranges and subranges therebetween such as, for example, 0.7 mm to 1.5 mm, etc.

The slit SIA of the applicator head S401 can have a length Ls1 and width w1. For example, the width w1 of the slit S1A of the head S401 can be approximately 1 mm. Similarly, the slit S1B of the applicator head S403 can have a length Ls3 and width w3. For example, the width w3 of the slit S1B of the head S403 can be approximately 1.4 mm. The slit S1C of the applicator head S404 can have a length Ls4 and width w4. For example, the width w4 of the slit S1C of the head S404 can be approximately 0.7 mm.

The length of the slit can extend from the end portion 101*a* (or 301*a*) of the applicator head 101 (or 301) up to the proximal end and/or the distal end. For example, the length of the slit can be between about 20% to 80% of the length of the length of the applicator head 101, preferably 30% to 70%, preferably 33% to 50%, including all ranges and subranges therebetween.

Figure 7:
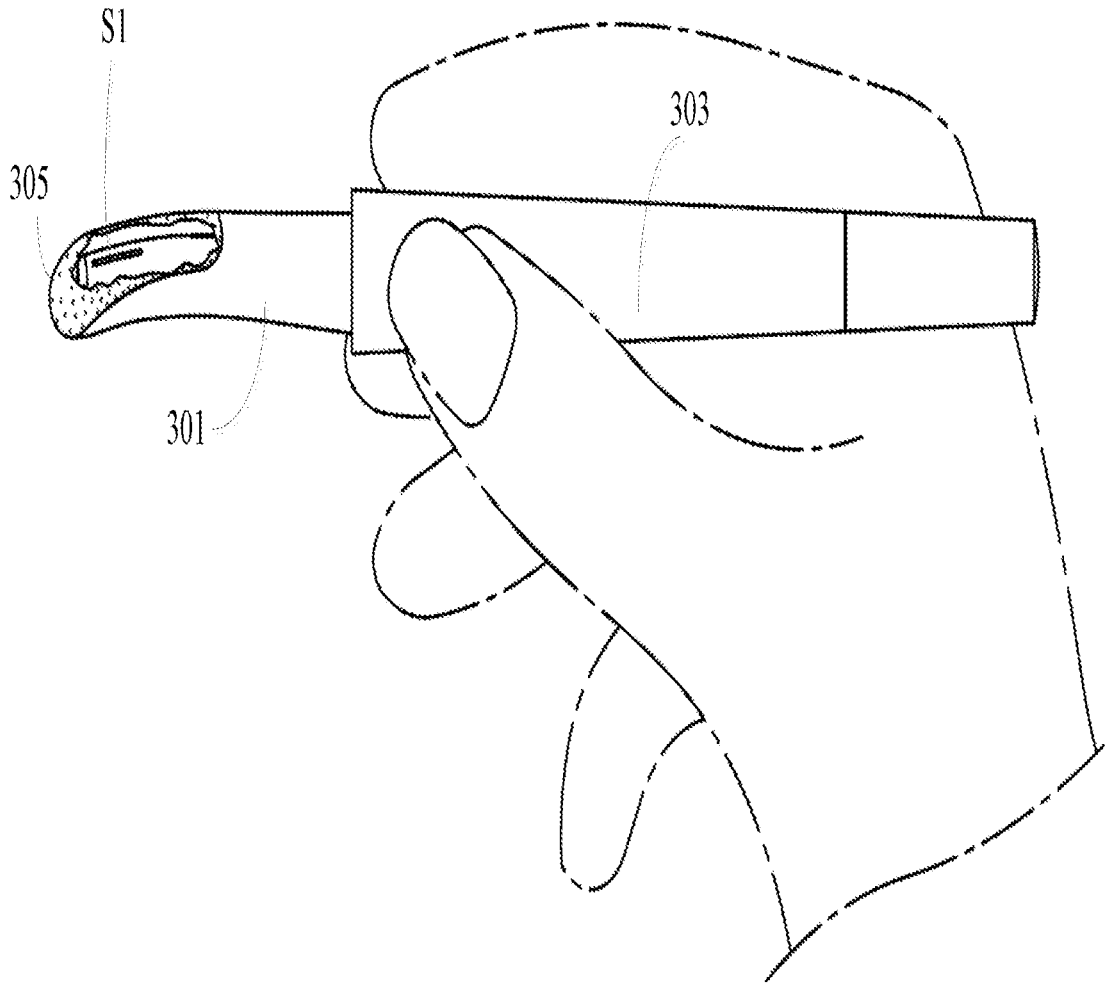
FIG. 7 illustrates an applicator with a slit under a flocked brush according to an exemplary embodiment of the present disclosure.

The slit controls an amount of mascara discharge on the flocked brush 105 (or 305). FIG. 7 illustrates a location of the slit with respect to the applicator head 101. The slit (31) is located on applicator head 301 (or 101) under the flocked brush 305 (or 105). The mascara discharged from the slit is received by the flocked brush 305 (or 105).

The amount of cosmetic composition such as mascara discharged can be a function of, among other things, the dimensions of the slit and cosmetic composition (mascara) properties including viscosity, consistency, critical strain, force applied to the tube 103 (or 303), and flock material. An optimum amount of mascara should be discharged to provide deposit of product on the flocked brush 105 (or 305), so that the mascara or cosmetic composition can be applied to a surface such as user's hair, eyelashes or eyebrows.

Cosmetic Composition

According to the present invention, a cosmetic composition for application to keratinous material is provided. Preferably, the cosmetic composition is a mascara and the keratinous material is eyebrows and/or eyelashes.

According to preferred embodiments, the cosmetic composition of the present invention possesses one or more of the following properties:

A consistency of 100,000 Pa or less, preferably 90,000 Pa or less, 80,500 Pa or less, preferably 80,000 Pa or less and greater than 500 Pa, preferably greater than 1000 Pa and preferably greater than 1100 Pa, including all ranges and subranges therebetween including, for example, 500 Pa to 100,000 Pa, preferably 1000 Pa to 90,000 Pa, and preferably 1100 Pa to 80,000 Pa;

A critical strain ($\gamma c$) of 11% or less, preferably 7.5% or less, preferably 4% or less, preferably 3% or less and greater than 0.1%, including all ranges and subranges therebetween including, for example, 0.1% to 11%, preferably 0.5% to 7.5% and preferably 0.6% to 6%;

Preferably, the cosmetic composition of present invention possesses at least two of the above properties, preferably at least three of the above properties, and preferably all four of the above properties.

In accordance with the present invention, the cosmetic composition can be in any form and can contain any ingredient typical of cosmetic compositions for application to keratinous materials.

The cosmetic compositions can be in any form such as, for example, an anhydrous composition, an oil-in-water (O/W) emulsion including a silicone-in-water emulsion, a water-in-oil (W/O) emulsion including a water-in-silicone emulsion, a multiple emulsion, etc. as long as the composition satisfies one or more of the criteria set forth above.

The cosmetic compositions can contain any ingredient used in compositions for application to keratinous materials such as, for example water, oils, colorants, waxes, film forming agents, thickeners, dispersants such as poly(12-hydroxystearic acid), antioxidants, sunscreens, preserving agents, fragrances, fillers, neutralizing agents, cosmetic and dermatological active agents such as, for example, emollients, moisturizers, vitamins, essential fatty acids, surfactants, silicone elastomers, pasty compounds, and mixtures thereof can be added. A non-exhaustive listing of such ingredients can be found in U.S. patent application publication No. 2004/0170586, the entire contents of which is hereby incorporated by reference. Further examples of suitable additional components can be found in the *International Cosmetic Ingredient Dictionary and Handbook* (9th ed. 2002).

According to preferred embodiments of the present invention, the compositions of the present invention may comprise at least one wax. Suitable examples of waxes that can be used in accordance with the present disclosure include those generally used in the cosmetics field: they include those of natural origin, such as beeswax, carnauba wax, candelilla wax, ouricoury wax, Japan wax, cork fibre wax or sugar cane wax, rice wax, montan wax, paraffin wax, lignite wax or microcrystalline wax, ceresin or ozokerite, and hydrogenated oils such as hydrogenated castor oil or jojoba oil; synthetic waxes such as the polyethylene waxes obtained from the polymerization or copolymerization of ethylene, and Fischer-Tropsch waxes, or else esters of fatty acids, such as octacosanyl stearate, glycerides which are concrete at 30° C., for example at 45° C., silicone waxes, such as alkyl- or alkoxydimethicones having an alkyl or alkoxy chain ranging from 10 to 45 carbon atoms, poly(di) methylsiloxane esters which are solid at 30° C. and whose ester chain comprising at least 10 carbon atoms, or else di(1,1,1-trimethylolpropane) tetrastearate, which is sold or manufactured by Heterene under the name HEST 2T-4S, and mixtures thereof.

If present, the wax or waxes may be present in an amount ranging from 0.1 to 15% by weight relative to the total weight of the composition, for example from 0.5 to 12.5%, and for example from 1 to 11%, including all ranges and subranges therebetween. However, according to particularly preferred embodiments of the present invention, the compositions of the present invention are wax-free.

According to preferred embodiments of the present invention, cosmetic compositions further comprising at least one coloring agent are provided. Preferably, such colored compositions can be cosmetic compositions such as mascaras.

According to this embodiment, the at least one coloring agent is preferably chosen from pigments, dyes, such as liposoluble dyes, nacreous pigments, and pearling agents.

Representative liposoluble dyes which may be used according to the present invention include Sudan Red, DC Red 17, DC Green 6, ß-carotene, soybean oil, Sudan Brown, DC Yellow 11, DC Violet 2, DC Orange 5, annatto, and quinoline yellow. The liposoluble dyes, when present, generally have a concentration ranging up to 20% by weight of the total weight of the composition, such as from 0.0001% to 6%, including all ranges and subranges therebetween.

The nacreous pigments which may be used according to the present invention may be chosen from white nacreous pigments such as mica coated with titanium or with bismuth oxychloride, colored nacreous pigments such as titanium mica with iron oxides, titanium mica with ferric blue or chromium oxide, titanium mica with an organic pigment chosen from those mentioned above, and nacreous pigments based on bismuth oxychloride. The nacreous pigments, if present, be present in the composition in a concentration ranging up to 50% by weight of the total weight of the composition, such as from 0.1% to 20%, preferably from 0.1% to 15%, including all ranges and subranges therebetween.

The pigments, which may be used according to the present invention, may be chosen from white, colored, inorganic, organic, polymeric, nonpolymeric, coated and uncoated pigments. Representative examples of mineral pigments include titanium dioxide, optionally surface-treated, zirconium oxide, zinc oxide, cerium oxide, iron oxides, chromium oxides, manganese violet, ultramarine blue, chromium hydrate, and ferric blue. Representative examples of organic pigments include carbon black, pigments of D & C type, and lakes based on cochineal carmine, barium, strontium, calcium, and aluminum.

If present, the coloring agents may be present in the composition in a concentration ranging up to 50% by weight of the total weight of the composition, such as from 0.5% to 40%, and further such as from 2% to 30%, including all ranges and subranges therebetween.

A person skilled in the art will take care to select the optional additional additives and/or the amount thereof such that the advantageous properties of the composition according to the invention are not, or are not substantially, adversely affected by the envisaged addition.

These substances may be selected variously by the person skilled in the art in order to prepare a composition which has the desired properties, for example, consistency or texture.

These additives may be present in the composition in a proportion from 0% to 99% (such as from 0.01% to 90%) relative to the total weight of the composition and further such as from 0.1% to 50% (if present), including all ranges and subranges therebetween.

Needless to say, the composition of the invention should be cosmetically or dermatologically acceptable, i.e., it should contain a non-toxic physiologically acceptable medium and should be able to be applied to the eyelashes of human beings.

According to preferred embodiments of the present invention, methods of treating, caring for and/or making up keratinous material such as lips, hair, eyebrows and eyelashes by applying cosmetic compositions of the present invention to the keratinous material using the cosmetic applicator of the present invention in an amount sufficient to treat, care for and/or make up the keratinous material are provided. Preferably, "making up" the keratin material includes applying at least one coloring agent to the keratin material in an amount sufficient to provide color to the keratin material.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective measurements. The following examples are intended to illustrate the invention without limiting the scope as a result. The percentages are given on a weight basis.

EXAMPLES

Example 1—Cosmetic Compositions

Example 1A—Commercially Available Comparative Compositions

Commercial Product A: Water, Paraffin, Potassium Cetyl Phosphate, Beeswax, Carnauba Wax, Acacia Senegal Gum, Glycerin, Cetyl Alcohol, Hydroxyethylcellulose, Sodium Polymethacrylate, Hydrogenated Jojoba Oil, Hydrogenated Palm Oil, Phenethyl Alcohol, Phenoxyethanol, Steareth 20, PEG/PPG 17/18 Dimethicone, Polyquaternium 10, Silica, Soluble Collagen, Simethicone, Panthenol, Disodium EDTA, May Contain (+/±): Iron Oxides (CI 77491, CI 77492, CI 77499), Titanium Dioxide (CI 77891), Ultramarines (CI 77007), Chromium Oxide Greens (CI 77288), Chromium Hydroxide Green (CI 77289), Manganese Violet (CI 77742), Ferric Ferrocyanide (CI 77510), Mica Commercial Product B: Water, Paraffin, Cyclomethicone, Stearic Acid, Beeswax, Triethanolamine, Acacia, Carnauba Wax, Dimethiconol, 2-Oleamido-1, 3-Octadecanediol, Hydroxyethylcellulose, Sodium Polymethacrylate, Panthenol, Imidazolidinyl Urea, Methylparaben, Ethoxydiglycol, Propylparaben, Simethicone, Polyquaternium-10. May Contain: Iron Oxides, Titanium Dioxide, Ultramarines.

Commercial Product C: Water, Propylene Glycol, Styrene/Acrylates/Ammonium Methacrylate Copolymer, Polyurethane-35, Cera Alba/Beeswax/Cine Dabeille, Synthetic Fluorphlogopite, Glyceryl Stearate, Cetyl Alcohol, PEG-200 Glyceryl Stearate, Ethylenediamine/Stearyl Dimer Dilinoleate Copolymer, Copernicia Cerifera Cera/Carnauba Wax/Cire de Camauba, Stearic Acid, Palmitic Acid, Ethylene/Va Copolymer, Alcohol Denat., Paraffin, Aminomethyl Propanediol, Glycerin, Hydroxyethylcellulose, Phenoxyethanol, Caprylyl Glycol, Butylene Glycol, Xanthan Gum, Sodium Laureth Sulfate, Disodium EDTA, Tetrasodium EDTA, Pentaerythrityl Tetra-Di-T-Butyl Hydroxyhydrocinnamate, Silica. May Contain: CI 77491, CI 77492, CI 77499/Iron Oxides, CI 77007/Ultramarines, CI 77891/Titanium Dioxide, MICA, CI 75470/Carmine, CI 77288/Chromium Oxide Greens, CI 77742/Manganese Violet, CI 77510/Ferric Ferrocyanide].

Commercial Product D: WATER, BUTYLENE GLYCOL, CALCIUM ALUMINUM BOROSILICATE, ACRYLATES COPOLYMER, STYRENE/ACRYLATES/AMMONIUM METHACRYLATE COPOLYMER, PENTYLENE GLYCOL, AMMONIUM ACRYLOYLDIMETHYLTAURATE/VP COPOLYMER, SILICA, PHENOXYETHANOL, SODIUM LAURETH-12 SULFATE, CAPRYLYL GLYCOL, TETRASODIUM EDTA, POTASSIUM SORBATE, IRON OXIDES Examples 1B1 through 1B3—Wax-Free O/W Mascara Emulsions

| Role | Ex. 1B1 | Ex. 1B2 | Ex. 1B3 |
|---|---|---|---|
| Film Former | 12.07 | 12.07 | 12.07 |
| Pigment | 10 | 10 | 10 |
| Organic or Silicon Oils | 5-9 | 5-9 | 5-9 |
| Oil Phase thickeners and emulsifiers, surfactants | 14-15 | 14-15 | 13-15 |
| Water phase thickeners | 0-0.3 | 0.9-1 | 0-0.3 |
| Preservatives, plasticizers, antioxidants | 6-9 | 6-9 | 6-9 |
| Solvent | 46.969 | 45-46 | 48.469 |

Preparation of O/W Emulsions

Water was heated to 60-70° C. with agitation using a large chopping blade (100 rpm).

Water was charged with pigments, preservatives, water soluble thickeners, water soluble emulsifiers, and plasticizers and mixed with a large rotor-stator homogenizer at 500-900 rpm until pigments dispersed (approx. 1 hr).

Oils, liquid fats, oil soluble emulsifiers and film formers were melted at 70-90 degrees C. and added to water phase using large rotor-stator homogenizer at 900-1200 rpm and emulsified for 30 minutes at 70-80 degrees C.

Once emulsified the composition was cooled to 50-60° C.

Temperature sensitive latex and silicone film former dispersions were then added and mixed for 20 minutes (1200 rpm).

The homogenizer was switched to slow sweeper blade and cooled to <30° C.

Examples 1B4 and 1B5—Anhydrous Lip Compositions

| Role/Ingredient | Ex. 1B4 | Ex. 1B5 |
|---|---|---|
| Preservatives, plasticizers, antioxidants | 1-1.5 | 1-1.5 |
| Filler, pigments | 10 | 10 |
| Film former | 30-40 | 30-40 |
| Oils, esters, emollients | 40-50 | 40-50 |
| Oil phase thickener | 1.2 | 1.2 |

Preparation of Anhydrous Compositions

Weighed Phase A (malate, octyldodecanol, resin, trimelliate, benzoate, and cinnamate) oils and heated to 98-100° C. with a Raynieri equipped with a homogenizing blade at 900 rpm.

Once temperature reached, added dextrin palmitate. Lowered temperature to 90° C.

In a separate beaker mixed preservatives and sticky polymers (polybutenes) followed by the pigments, pearls and fillers.

Cooled to room temperature and dropped the batch.

Example 1B6—W/O Emulsion

| Role/ Ingredient | Ex. 1B6 |
|---|---|
| Pigments | 8-12 |
| Oil Phase thickener | 0.63 |
| Film former | 7-11.45 |
| Solvents, oil, silicon oil, wax | 60-75 |
| Preservative, plasticizer, antioxidant, neutralizer, ion source, neutralizer | 4.5-5 |
| Filler | 4-5.2 |

Example 2—Testing of Composition Properties

Compositions in Example 1 were tested for viscosity, complex modulus (G*) and critical strain (γc) properties. The extrusion force associated with applying compositions in example 1 via applicators of the present invention was also determined. Results for identified compositions are identified below.

Example 2A—Testing Protocols

Viscosity. Method A. The viscosity of the formulas were measured at 25° C. with a Brookfield DVIIT viscometer in the absence of the guard leg, using the spindle and rpm listed in Table 4 (hereinafter, "Method A"). The reported viscosity is that shown is that after 10 minutes after switching on the rotation of the spindle (when a constant torque is read) and the values are reported in cps.

Consistency and critical strain. Method B. Complex modulus (G*) and critical strain (γc) of inventive compositions determined from a strain sweep experiment at 20° C. using a TA instrument AR-G2 or AR-DH2 rheometer and a 40 mm stainless steel 2° cone or crosshatch probe from 0.01 to 1000% strain at 1 rad/sec angular frequency.

Extrusion Force. Tubes were filled with 15 grams of bulk and sealed. Tubes placed on balance on their side and balance was tarred. Tube pressed with hand and the amount of force required to dispense the product was recorded. The result of dispensing was also recorded. The result of dispense was recorded as tubes, uneven mountain, tubes that wet evenly along the applicator, even applicator wetting.

Example 2B—Testing of Compositions in Example 1

Rheologic properties of compositions in example 1 (n=2) determined according to Method B are set forth below.

| Composition | G* (0.1% Strain) (Consistency, Pa) | Critical Strain (γc, %) |
|---|---|---|
| 1B1 | 1315 | 5.3 |
| 1B3 | 297 | 2.7 |
| 1B6 | 236 | 5.5 |
| 1B2 | 5054 | 4.2-11 |
| Commercial Product A | 7605 | 0.42 |
| Commercial Product B | 9570 | 0.66 |
| Commercial Product C | 15620 | 0.64 |

Viscosities of compositions in example 1 determined according to Method A above are set forth below.

| Composition | Viscosity (cP) | Spindle | Rpm | % Torgue |
|---|---|---|---|---|
| 1B4 | 3380 | RV-4 | 30 | 50 |
| 1B5 | 4570 | RV-4 | 20 | 45 |
| 1B2 | 33440 | RV-7 | 50 | 50 |
| 1B1 | 41200 | RV-6 | 10 | 41 |
| 1B3 | 3480 | RV-5 | 50 | 43.6 |
| 1B6 | 9060 | RV-4 | 10 | 45 |

Example 3—Testing of Cosmetic Systems of the Present Invention

Example 3A—Basic Applicators for Evaluating Cosmetic Compositions

Applicators as depicted in FIGS. 6A, 6B and 6C were used in conjunction with compositions from Example 1B. The formulations evaluated included W/O formulation (Example 1B6), wax-free mascara O/W formulations (Examples 1B1-3) and anhydrous lip gloss compositions (Examples 1B4-5). Commercial products were also tested.

Example 3B—Evaluation of Dispensing Force for Composition 1B1 in Applicators With Varying Slit Sizes Dispensing force associated with Composition 1B1 was evaluated in dispensers containing slits of varying sizes (diameters). The results determined according to Method C above are set forth in FIG. 8.

Figure 8:
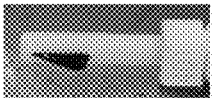
FIG. 8 shows the results of evaluating a dispensing force for Composition 1B1 in applicators with varying slit sizes.
Figure 8:
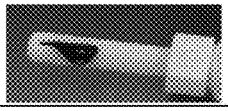
Figure 8:
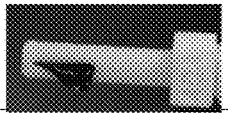

FIG. 8 demonstrates that a formula with a viscosity of 41200 cps (RV-6, 10 rpm) dispensed unevenly using applicators having slit sizes of 0.7 mm to 1.4 mm.

Example 3C—Evaluation of Dispensing Force for Composition 1B3 in Applicators With Varying Slit Sizes FIG. 9 demonstrates that a formula with a viscosity of 3480 cps (RV-6, 10 rpm) dispensed unevenly using an applicator having a slit size of less than 0.8 mm (0.7 mm). The data also demonstrates that applicators having slits of 1.1 nm to 1.4 mm resulted in a mountain that required higher force to dispense but also resulted in good control of amount of product dispensed.

Figure 10:
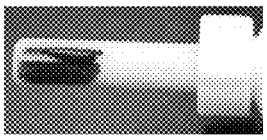
FIG. 10 shows the results of evaluating a dispensing force for Commercial Product A in an applicator with a slit size of 1 mm.

Example 3D—Evaluation of Dispensing Force for Commercial Product A in Applicators With Slit The result are set forth in FIG. 10.

Commercial Product A, which can be representative of more traditional mascaras containing waxes and having lower consistencies (G* between 5000 Pa and 10000 Pa), was dispensed with forces less than 1300 grams in a system having an applicator with a slit greater than 1 mm.

What is claimed is:

1. A cosmetic system comprising:

(a) a cosmetic applicator comprising a deformable container configured to store a cosmetic composition;

an applicator head having a non-linear shape with a proximal end and a distal end and a slit along an axis of the applicator head, the distal end connected to the container;

an interior applicator channel in the applicator head; and a flocked brush extending along the applicator head covering at least a portion of the slit, and (b) a cosmetic composition, wherein the flocked brush covers a length of the applicator head from the proximal end to the distal end that is less than the length of the applicator head on a first plane of the applicator head and on a second plane of the applicator head the flocked brush covers a length of the applicator head from the proximal end to the distal end that is less than the length of the applicator head and less than the length of the flocked brush on the first plane of the applicator head.

2. The cosmetic system according to claim 1, wherein the flocked brush covers the entirety of the slit.

3. The cosmetic system according to claim 1, wherein the applicator head is curved with an angle between the proximal end and the distal end such that the first plane of the applicator head has a convex surface and the second plane has a concave surface.

4. The cosmetic system according to claim 1, wherein the interior applicator channel is tapered.

5. The cosmetic system according to claim 1, wherein the flocked brush is made of a material having (a) 1.5 to 90 dtex, (b) 0.5 to 3 mm in length, and (c) 0.03 to 0.09 mm in diameter.

6. The cosmetic system according to claim 1, wherein the cosmetic composition has at least one of the following properties: (a) a consistency of 100,000 Pa or less, or (b) a critical strain of 11% or less.

7. A method of applying mascara to eyelashes comprising applying the mascara to eyelashes with the cosmetic system of claim 1.

8. The cosmetic system according to claim 1, wherein the flocked brush covers one-third to one-half of a circumference of the applicator head.

9. A cosmetic system comprising:

(a) a cosmetic applicator comprising a cylindrical container configured to store a cosmetic composition having a depressible element;

an applicator head having a non-linear shape with a proximal end and a distal end and a slit along an axis of the applicator head, the distal end connected to the container; and a flocked brush extending along the applicator head covering at least a portion of the slit, and (b) a cosmetic composition, wherein the flocked brush covers a length of the applicator head from the proximal end to the distal end that is less than the length of the applicator head on a first plane of the applicator head and on a second plane of the applicator head the flocked brush covers a length of the applicator head from the proximal end to the distal end that is less than the length of the applicator head and less than the length of the flocked brush on the first plane of the applicator head.

10. The cosmetic system according to claim 9, wherein the flocked brush covers the entirety of the slit.

11. The cosmetic system according to claim 9, wherein the applicator head is curved with an angle between the proximal end and the distal end such that the first plane of the applicator head has a convex surface and the second plane has a concave surface.

12. The cosmetic system according to claim 9, wherein tine cylindrical container is deformable.

13. The cosmetic system according to claim 9, wherein the depressible element is a movable piston.

14. The cosmetic system according to claim 9, wherein the flocked brush is made of a material having (a) 1.5 to 90 dtex, (b) 0.5 to 3 mm in length, and (c) 0.03 to 0.09 mm in diameter.

15. The cosmetic system according to claim 9, wherein the cosmetic composition has at least one of the following properties: (a) a consistency of 100,000 Pa or less, or (b) a critical strain of 11% or less.

16. A method of applying mascara to eyelashes comprising applying the mascara to eyelashes with the cosmetic system of claim 9.

17. The cosmetic system according to claim 9, wherein the flocked brush covers one-third to one-half of a circumference of the applicator head.

* * * * *